United States Patent [19]

Yamamoto et al.

[11] 4,095,433

[45] Jun. 20, 1978

[54] TUNNEL SUPPORT STRUCTURE USING BUILT-UP PIPE SUPPORT SET, AND UNIT PIPE SUPPORT MEMBER THEREFOR

[75] Inventors: Minoru Yamamoto, Machida; Juntaro Honda, Kobe; Katsumi Nagasaki, Sakai; Yoshito Seto, Yamato-Koriyama, all of Japan

[73] Assignee: Kubota, Ltd., Osaka, Japan; a part interest

[21] Appl. No.: 730,343

[22] Filed: Oct. 7, 1976

[30] Foreign Application Priority Data

Oct. 9, 1975 Japan ..... 50-122212

[51] Int. Cl.[2] ..... E21D 7/00

[52] U.S. Cl. ..... 61/45 C; 61/45 R

[58] Field of Search ..... 61/45 C, 45 R, 84, 85, 61/42; 285/405, 397; 138/172

[56] References Cited

U.S. PATENT DOCUMENTS

| | | | |
|---|---|---|---|
| 253,493 | 2/1882 | Austin | 138/172 X |
| 724,675 | 4/1903 | Decker | 285/405 X |
| 881,770 | 3/1908 | Boyd | 138/172 X |
| 1,025,186 | 5/1912 | Hill | 138/172 X |
| 1,037,709 | 9/1912 | Zieg | 138/172 X |
| 1,057,098 | 3/1913 | Smith | 138/172 X |
| 1,188,485 | 6/1916 | Pruyn | 285/297 X |
| 1,220,773 | 3/1917 | Murray | 138/172 X |
| 1,324,714 | 12/1919 | Allen | 138/172 UX |
| 1,607,725 | 11/1926 | Davis | 285/397 X |
| 1,733,455 | 10/1929 | Ferrand | 138/172 |
| 3,396,545 | 8/1968 | Lamberton | 61/45 R X |
| 3,524,320 | 8/1970 | Turzillo | 61/45 R X |

FOREIGN PATENT DOCUMENTS

| | | | |
|---|---|---|---|
| 1,231,578 | 9/1960 | France | 61/45 C |
| 518,303 | 2/1931 | Germany | 61/45 C |
| 681,267 | 9/1939 | Germany | 61/45 C |
| 1,236,448 | 3/1967 | Germany | 61/45 C |
| 241,729 | 1/1964 | Netherlands | 61/45 C |
| 641,779 | 8/1950 | United Kingdom | 61/45 C |
| 819,211 | 9/1959 | United Kingdom | 61/45 C |
| 986,448 | 3/1965 | United Kingdom | 61/45 C |

*Primary Examiner*—Dennis L. Taylor
*Attorney, Agent, or Firm*—Joseph W. Farley

[57] ABSTRACT

Structure for supporting the excavated wall of a tunnel comprises a plurality of unit pipe support members connected in end-to-end relation by pipe couplings with lap joints, or by flanges on the ends of the support members, to form a plurality of sub-assemblies which are then connected by a closure member to form a pipe support having a periphery substantially conforming to the periphery of the tunnel wall, and having ports through which the pipe support can be filled with mortar or concrete. The unit pipe support members are substantially the same size and shape for mass production from ductile cast iron or cast steel and are provided with integral reinforcing ribs.

8 Claims, 39 Drawing Figures

FIG.3a
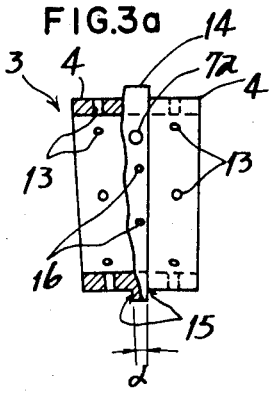
FIG.3b
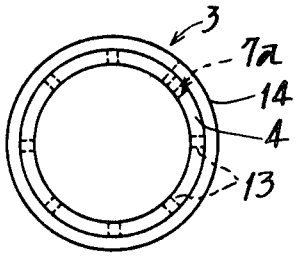
FIG.4
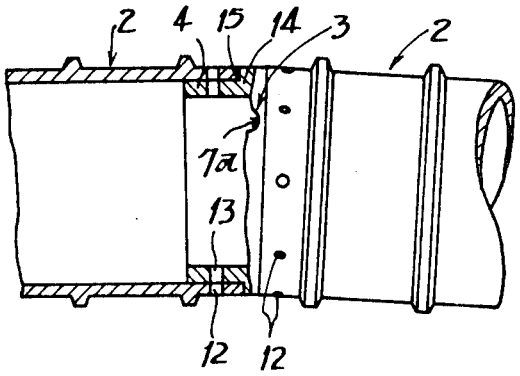
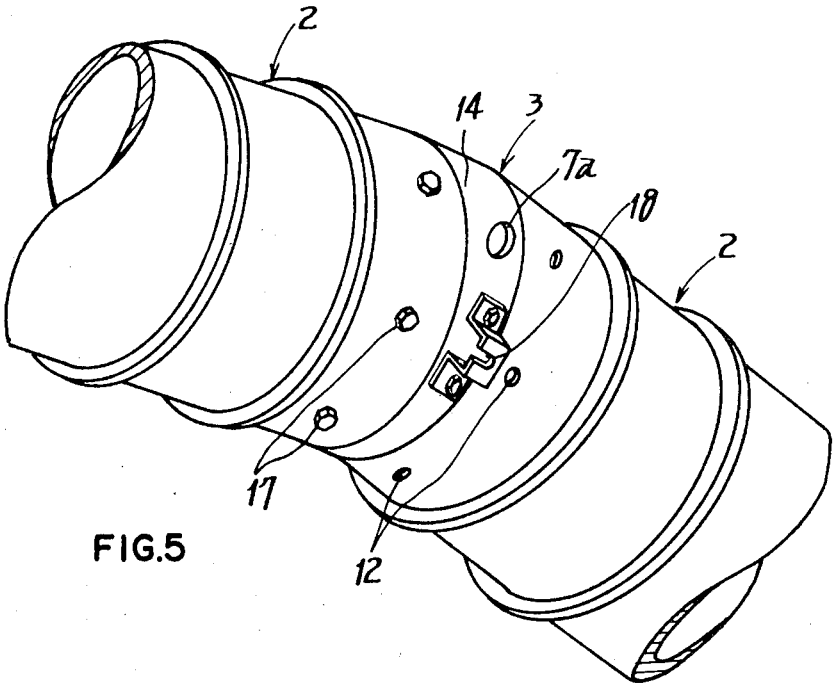
FIG.5

FIG.23a
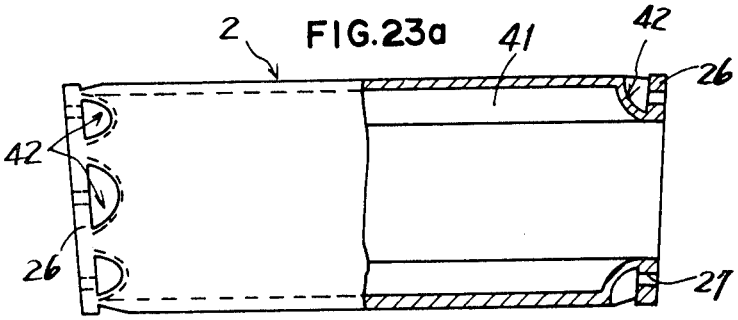
FIG.23b
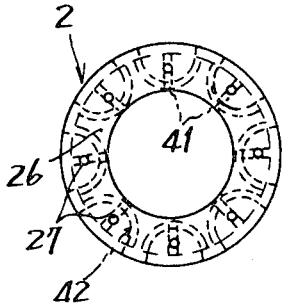
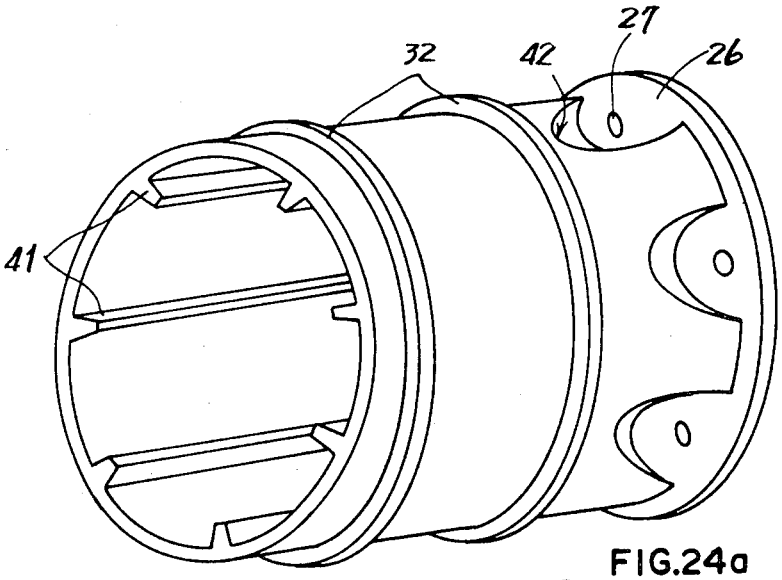
FIG.23c
FIG.24a
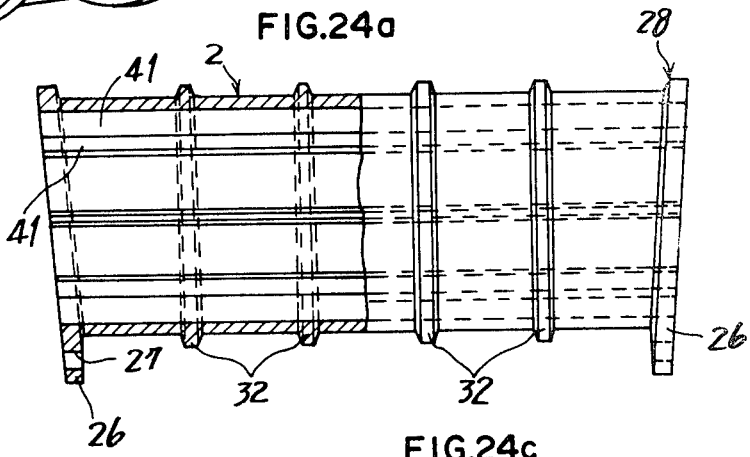
FIG.24b
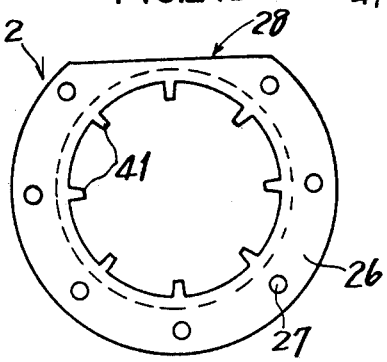
FIG.24c
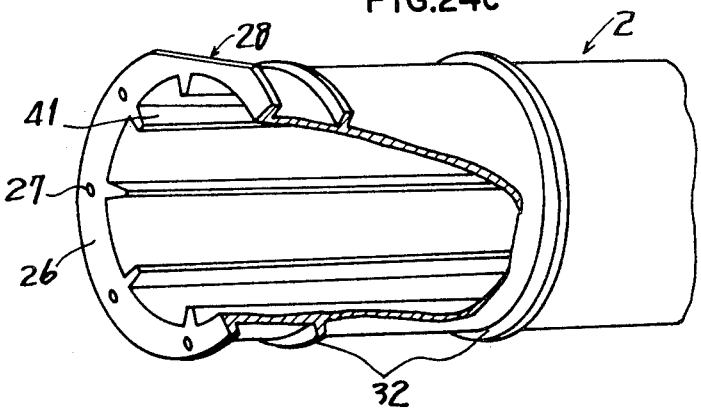

TUNNEL SUPPORT STRUCTURE USING BUILT-UP PIPE SUPPORT SET, AND UNIT PIPE SUPPORT MEMBER THEREFOR

The present invention relates to a support structure used for supporting the wall of a tunnel bore from the time the excavation of a tunnel is completed until the beginning of lining, and particularly to a support structure using pipe support members. More particularly, it relates to such structure in which said pipe support members are of the built-up type.

In constructing a tunnel, in order to support the wall of a tunnel bore from the time the excavation of a tunnel is completed until the beginning of lining so as to prevent the deformation and failure of the earth, it is usual practice to build support members in contact with the excavated surface of the tunnel and at suitable intervals longitudinally of the tunnel, thereby supporting the tunnel. Such support structures include a type using pipe support members. This type of support structure comprises slender support members in the form of pipes bent to the cross-sectional shape of the tunnel, usually 2 to 5 pieces of identical or substantially identical support members being used to build an arch-shaped, U-shaped or circular support structure at the cutting face. Said support members are connected together by butt joints using bolts, whereupon cement mortar serving as a core filler is poured thereinto through pouring ports formed in the support members. The support structure using pipe support members, as described, is used mainly as a heavy load support structure in which the pipes and the core filler cooperate with each other to support the load of the earth. With such support structure, however, it is necessary to bend the pipes to the cross-sectional shape of the tunnel and provide special support members suited to the cross-sectional shape of each particular tunnel, thus involving the disadvantage of the material cost being high. Generally, in the case of a compression member made of reinforced concrete, it is known that if it is reinforced with hoops or spiral reinforcement, it is possible to increase the load resisting capacity and tenacity of the pillar with respect to compressive force. Thus, in the case of said pipe support structure, a spiral reinforcement is attached to each support member if the latter is used for heavy load supporting purposes, with the intention of improving the load resisting property of the support structure. However, the necessity of the additional steps of working such spiral reinforcement and inserting and fixing it in the pipe results in the support structure being expensive. Further, the presence of the spiral reinforcement necessitates using a core filler of high flowability, the selection of materials being difficult, and another problem is that in performing construction, unfilled spaces are liable to be created around the spiral reinforcement.

The main object of the present invention is to provide a tunnel support structure which solves the above problems and has a satisfactory load resisting property. This support structure comprises a number of unit pipe support members connected in end-to-end relation by connector means to provide a plurality of pipe support sub-sets shaped to the cross-section of the earth wall, said pipe support sub-sets being connected together by closure means in such a manner as to close their ends to thereby provide a pipe support set having an outer periphery adapted to be positioned close to the entire periphery of the earth wall. Thus, a pipe support set suited for a tunnel having a given shape of excavated surface can be formed by using unit pipe support members of substantially the same shape, and since such unit pipe support members can be mass-produced, the material cost can be reduced. Further, the transport and materials management are facilitated, and in this respect also it is economical. Further, the formation of a pipe support set at the cutting face can be easily carried out by assembling a plurality of pipe support sub-sets in advance, building said pipe support sub-sets and then connecting them together by using closure means to form a pipe support set. The pipe support set thus formed is capable of fully performing the function of a support structure.

Further, the invention provides a unit pipe support member in the form of a casting of ductile cast iron or cast steel having reinforcing ribs integrally cast at least on one of the inner and outer surfaces thereof. According to this construction, a material for pipe support sets can be provided at very low cost by a mass-production process using casting. Further, since this unit pipe support member is integrally formed with reinforcing ribs, its compressive strength is so high that it can support the heavy earth load without the need to pack it with a core filler as in a conventional pipe support member. It goes without saying, however, that there are cases where a core filler is used. Preferably, said reinforcing rib is in the form of a continuous annular or spiral rib extending circumferentially of the unit pipe support member. Such reinforcing rib plays the same dynamics role as that of a hoop or spiral reinforcement attached to a conventional pipe support member. That is, when a compressive force acts on the unit pipe support member, it performs the function of preventing the radial displacement of the peripheral wall. As a result, it has the effect of adding to the strength and rigidity of the unit pipe support member. Furthermore, the formation by casting is advantageous to production since this needs no steps of production including the working, transporting, inserting and fixing of spiral reinforcement.

Further, according to a preferred embodiment of the invention, a metal fitting is used which has lap connector portions adapted to be fitted in the ends of said unit pipe member and serving as said connector means and closure means. According to this arrangement, unit pipe support members are firmly connected by the lap connector portions to provide a rigid pipe support set. Further, by preparing metal fitting of various shapes, it is possible to use unit pipe support members of exactly the same shape irrespective of the cross-sectional shape of tunnels. On the other hand, there are cases where said connector means and closure means are in the form of connector flanges integrally formed on the ends of unit pipe support members, and in those cases the region where unit pipe support members are connected together is very rigid.

Further, the invention includes an arrangement in which a pipe support set is filled with a core filler. In this case, a pipe-like metal fitting having lap connector portions at the opposite ends is used as said connecting or closing metal fitting. By forming this pipe-like metal fitting with a core filler pouring port, it is possible to futher simplify the shape of the unit pipe support members and increase their applicability. Further, in filling with the core filler, since said rib is integral with the unit pipe support member, there is no need to pay special attention to the filling operation. Not to speak of filling by pouring of cement mortar, filling by pouring of concrete can be easily performed. However, it is also possible to employ prepacked concrete wherein aggregate is first charged and then cement milk is poured.

Other numerous features and effects of the invention will be readily understood from the following description of embodiments of the invention with reference to the accompanying drawings.

FIGS. 1 through 7 show a first embodiment of the invention, of which FIG. 1 is a front view of a complete arch-shaped support structure;

FIG. 2 is a perspective view showing how to connect unit pipe support members;

Figure 6A:
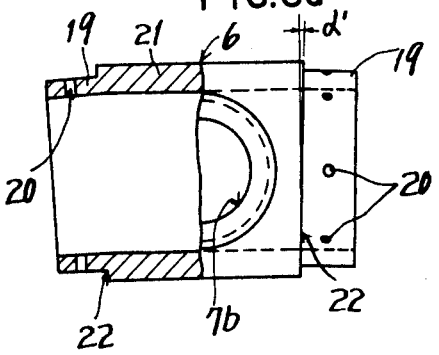
Figure 6B:
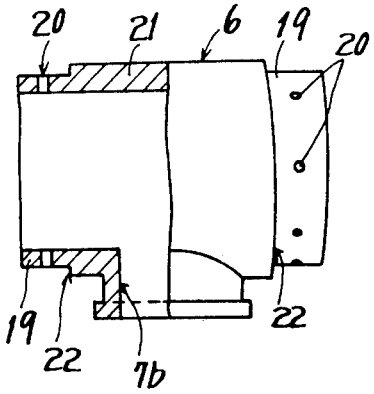
Figure 6C:
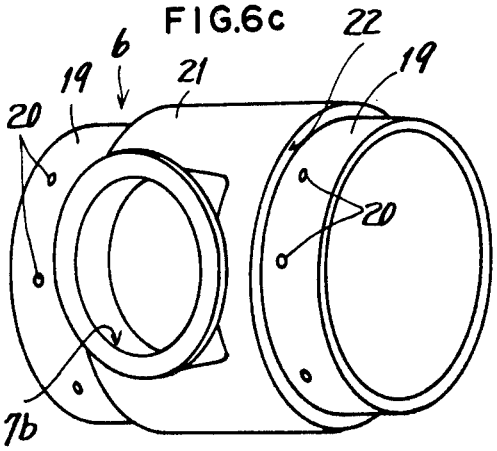

FIG. 3*a* is a front view, partly in section, of a connector pipe;

FIG. 3*b* is a side view of said connector pipe;

FIGS. 4 and 5 show unit pipe support members in connected condition;

FIG. 6*a* is a front view, partly in section, of a closure pipe;

FIG. 6*b* is a plan view, partly in section, of said closure pipe;

FIG. 6*c* is a perspective view of said closure pipe; and

Figure 7:
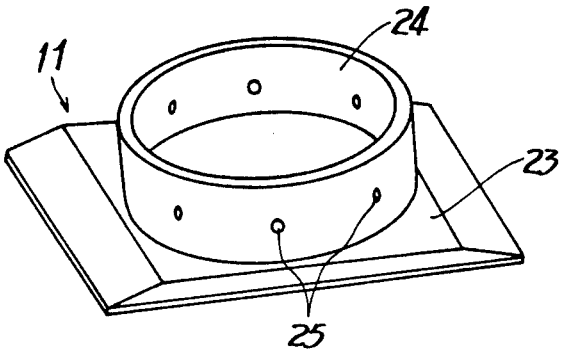

FIG. 7 is a perspective view of an end metal fitting;

FIGS. 8 through 11 show a second embodiment of the invention, of which

Figure 8:
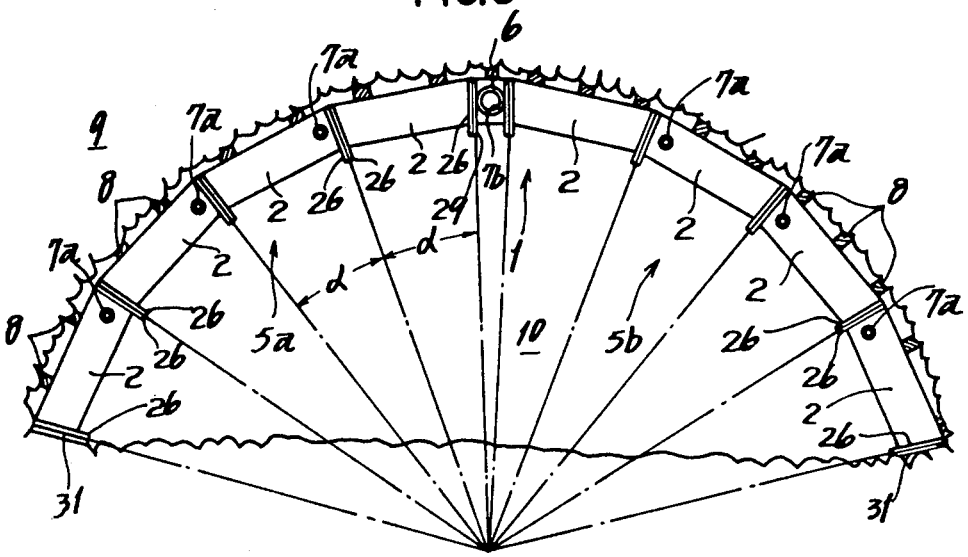
Figure 10:
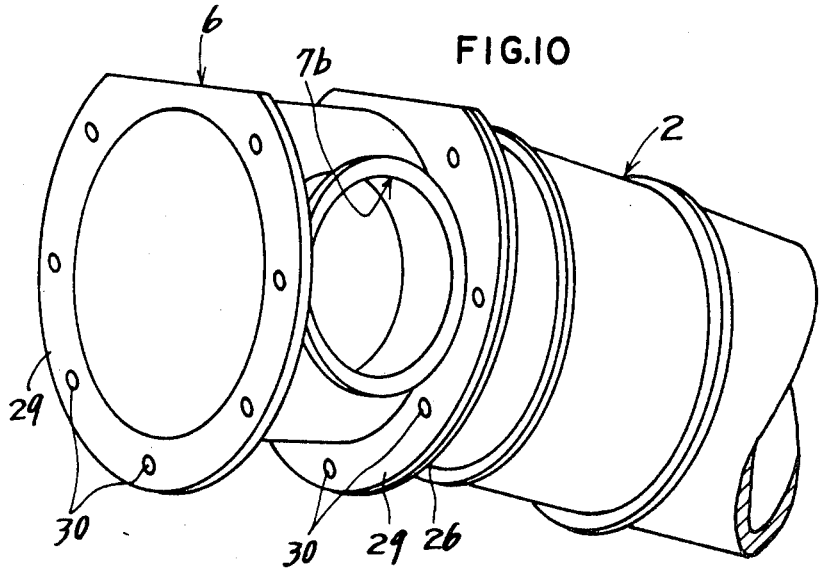
Figure 9:
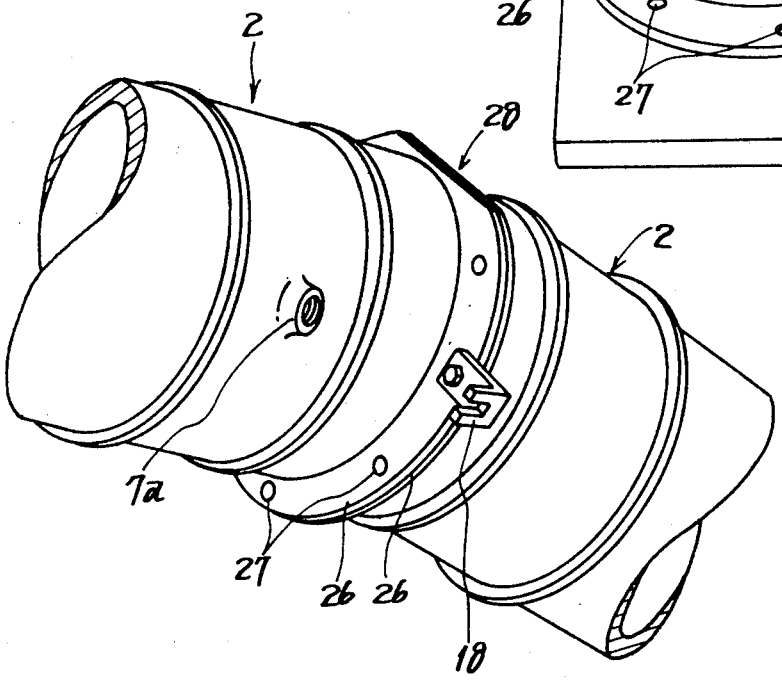

FIG. 8 is a front view of a complete arch-shaped support structure;

FIG. 9 is a perspective view showing unit pipe support members in connected condition;

FIG. 10 is a perspective view of a closure pipe in connected condition; and

Figure 11:
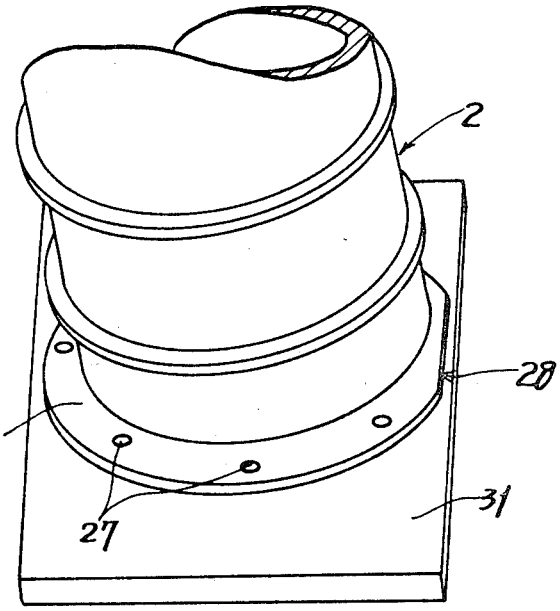
Figure 28A:
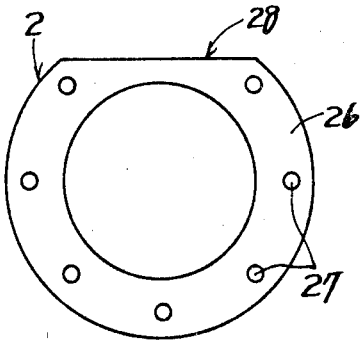
Figure 28B:
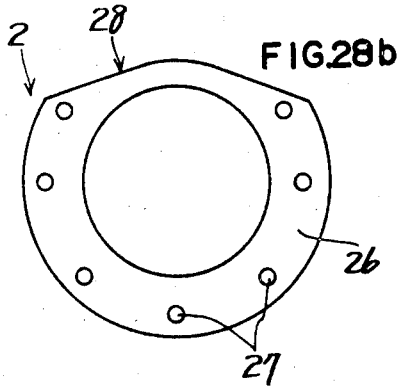

FIG. 11 is a perspective view of an end metal fitting in attached condition;

FIGS. 12 through 16 are front views, partly in section, showing examples of the construction of the unit pipe support member used in the first embodiment;

FIGS. 17 through 27 are front views, partly in section, showing examples of the construction of the unit pipe support member used in the second embodiment; and FIGS. 28*a* and 28*b* are side views showing examples of the shape of the connector flange.

Figure 1:
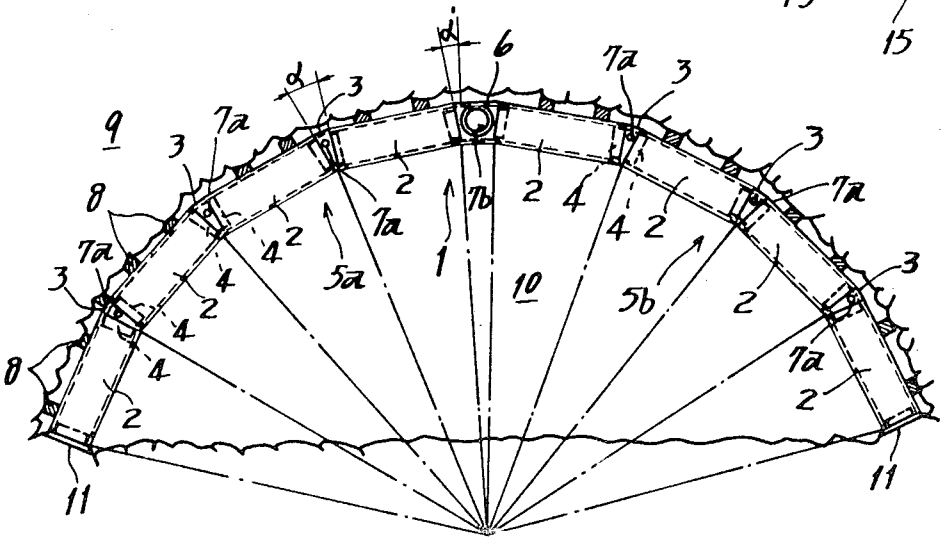

First of all, a first embodiment of the invention will be described with reference to FIGS. 1 through 7. This built-up pipe support set 1, as can be seen in FIG. 1 showing an arch-shaped support structure (examples in which it is U-shaped or circular are not illustrated), comprises unit pipe support members 2 in the form of straight or curved members substantially identical in shape, said unit pipe support members being connected in a polygonal line or in a curve through connector pipes 3 having lap joint portions 4 adapted to be fitted therein, so as to provide pipe support sub-sets 5*a*, 5*b*, usually two in the case of an arch-shaped support structure, said two pipe support sub-sets 5*a*, 5*b* being then closed up by a closure pipe 6 to form said pipe support set 1 conforming to the excavated cross-sectional shape of a tunnel 10, with a core filler poured into the cavities in the two pipe support sub-sets 5*a*, 5*b* through a pouring port 7*b* formed in said closure pipe 6 or pouring ports 7*a* formed in said connector pipes 3. If concrete mixed with aggregate of large particle size is used a core filler, the pouring port 7*b* in the closure pipe 6 is given a large diameter, as illustrated, through which it is poured. On the other hand, if cement mortar is used as a core filler, it is sufficient to use only the pouring ports 7*a* in the connector pipes 3, and in such case the closure pipe 6 may be replaced by a connector pipe 3. Further, core filling may be carried out by pouring only aggregate through the pouring port 7*b* and pouring cement milk by utilizing the pouring ports 7*a* in the connector pipes 3. In addition, FIG. 1 illustrates a case where the unit pipe support members 2 are straight members. The numeral 8 designates sheet piles driven between the pipe support set 1 and the excavated surface of the earth 9 and 11 designates end metal fittings installed at the opposite ends of the pipe support set 1.

The components of the first embodiment shown in FIG. 1 will now be described with reference to FIGS. 2 through 7. In addition, when the unit pipe support members 2 are curved members, no particular explanation will be necessary since the following description is applicable thereto.

Figure 2:
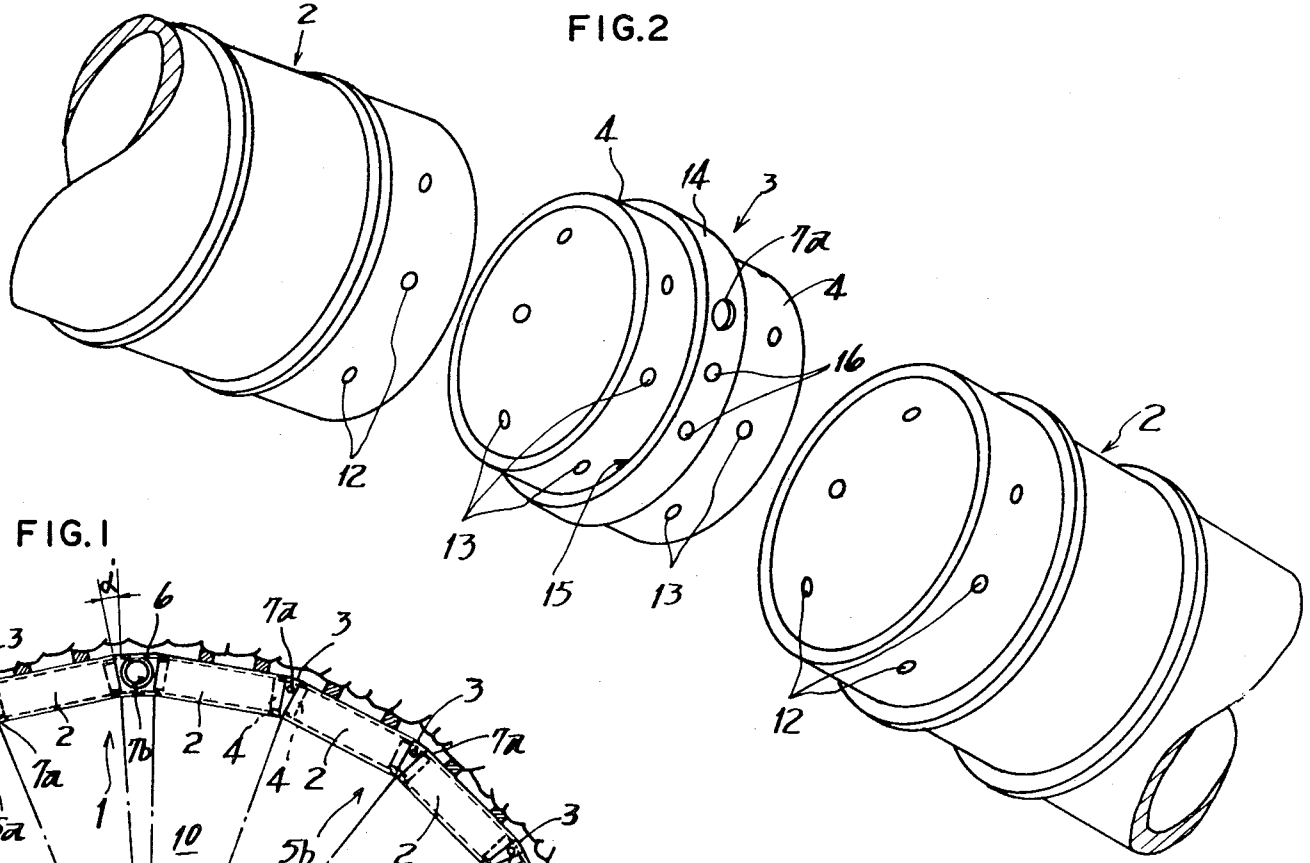

In FIG. 2, at a plurality of circumferentially disposed places on each end of each unit pipe support member 2 there are provided threaded holes or through-holes 12 while the lap joint portions 4 of each connector pipe 3 are formed with threaded holes or through-holes 13 so that the holes 13 may be aligned with the holes 12 when the ends of the unit support pipe 2 are fitted on the lap joint portions. The connector pipe 3, as shown in FIGS. 3*a* and 3*b*, comprises a thick-walled large diameter engagement step portion 14 between the lap joint portions, 4, 4 at the opposite ends, the engagement surfaces 15, 15 on opposite sides of said engagement step portion 14 having an angle of inclination a, defined therebetween, said lap joint portions 4 projecting at right angles to said engagement surfaces. Designated at 7*a* is a core filler pouring hole formed in the engagement step portion 14, and 16 is a threaded hole for a metal fitting for attachment to a connector bolt which connects pipe support sets 1 together.

Such unit pipe support members 2 and connector pipes 3 are alternately connected together in such a manner that, as shown in FIG. 4, the lap joint portions 4 are fitted in the ends of the unit pipe support member 2, whereby the unit pipe support members 2 are interconnected through the connector pipes 3 in a polygonal line having an angle of inclination *a*, and then, as shown in FIG. 5, slipping-off-prevention for them is effected by set screws 17 or bolts, thereby completing the connection. Further, metal fittings 18 are attached to the connector pipes 3 by utilizing the threaded holes 16 so that the pipe support set 1, after being built, may be connected to the rear pipe support set by connector bolts (not shown).

The closure pipe 6, as shown in FIGS. 6*a*, 6*b* and 6*c*, comprises, as in the case of the connector pipe 3, lap joint portions 19 on the opposite sides thereof to be fitted in the ends of the unit pipe support members 2, said lap joint portions being formed with threaded holes or through-holes 20, a thick-walled large diameter closure pipe portion 21 disposed between said lap joint portions 19, 19 and having a core filler pouring port 7*b*, the engagement surfaces 22, 22 on the opposite sides of said closure pipe portion having an angle of inclination $\alpha'$, defined therebetween, said lap joint portions 19 projecting at right angles to said engagement surfaces 22. This angle of inclination $\alpha'$, depends on the size of the pouring port 7*b*, but usually it may be equal to the angle of inclination $\alpha$. Taking cement mortar as an example of the core filler for the pipe, since there is no need to take the trouble to enlarge the pouring port 7*b* in the closure pipe 6, the connector pipe 3 may be used as the closure pipe 6 to perform closing-up. On the other hand, taking core filling by concrete as an example, it is advisable to use the closure pipe 6 having the pouring port *7b* of large diameter to close the support structure.

The end metal fitting 11, as shown in FIG. 7, comprises a bottom plate 23 on which a lap joint portion 24 is integrally formed, said lap joint portion being formed with threaded holes 25, as in the case of the above described lap joint portions.

The components of the built-up pipe support set shown in FIG. 1 are as described above. In order to assemble the pipe support sub-sets 5 therefor, the end metal fitting 11 is first attached to the unit pipe support member 2 and set screws are applied thereto, and then a lap joint portion 4 of the connector pipe 3 is fitted in the other end of this unit pipe support member 2 and set screws are applied thereto. One end of the next unit pipe support member 2 is fitted on said connector pipe 3 and set screws are applied thereto, and for the subsequent units the same operation is repeated until a predetermined length of pipe support sub-set 5 is obtained. In the case of an arch-shaped support set, two such pipe support sub-sets as shown at 5*a*, 5*b* in FIG. 1 are prepared and built at the face and then closed up, for example, by a closure pipe 6 having a large pouring port *7b* shown in FIG. 1. In closing up the pipe support sub-sets, the crown of the arch-built pipe support sub-sets 5*a*, 5*b* is opened and a closure pipe 6 is inserted to close them up and bolts are brought into the pouring port *7b* and inserted into the holes 20 from the inside and tightened with nuts applied thereto from outside the unit pipe sub-sets 2. Upon completion of the building of the pipe support, if core filling is to be effected by using prepacked concrete, for example, aggregate is poured into the cavities of the pipe support sub-sets 5*a*, 5*b* through the pouring port *7b*, whereupon the latter is plugged. Using the pouring ports *7a* in the closure pipes 3, the pouring of cement milk is effected successively from the lower position, thereby completing the core filling. In addition, when concrete is used for core filling, it is poured through the pouring port *7b*, while when cement mortar is used for core filling, a closure pipe 3 is used to effect closing-up as described above.

Describing a second embodiment with reference to FIGS. 8 through 11, this built-up pipe support set 1, as shown in FIG. 8, dispenses with the connector pipes 3 used in the first embodiment, by employing connector flanges 26 at the opposite ends of each pipe support member 2, which is a straight or curved member and substantially identical in shape with the others. The two connector surfaces on the opposite ends of such connector flange 26 have an angle of inclination $\alpha$ so as to face toward the center of curvature of the tunnel 10. In order to improve contact between the pipe support set 1 and the excavated surface of the tunnel 10, the portion of each connector flange 26 which is disposed outside the outer peripheral edge of the pipe support set 1, i.e., on the excavated surface side is cut away so that the flange may not project toward that side.

Describing the arrangement in more detail with reference to FIGS. 9 through 11, the connector flanges 26 for the unit pipe support members 2, as shown in FIG. 9, are formed with bolt holes 27 at a plurality of circumferentially disposed places so that the flanges may be clamped together by bolts and nuts. Designated at 28 is a cut-away portion. Further, each unit pipe support member 2 is provided with a boss formed with a pouring port *7a* corresponding to the pouring port in said connector pipe 3. Further, the opposite ends of the closure pipe 6, as shown in FIG. 10, are provided with flanges 29 and bolt holes 30 corresponding to said flanges 26 and bolt holes 27. In this second embodiment, the closure pipe 6 may be replaced by a unit pipe support member 2. Further, each end of the pipe support set 1 is provided with a plate-like end metal fitting 31 which is attached to a unit pipe support member by bolts extending through the bolt holes 27 in the connector flange 26. The constructional differences from the first embodiment are as described above, the other points including the assembling of the pipe support set 1 being substantially the same as in the first embodiment.

Figure 12:
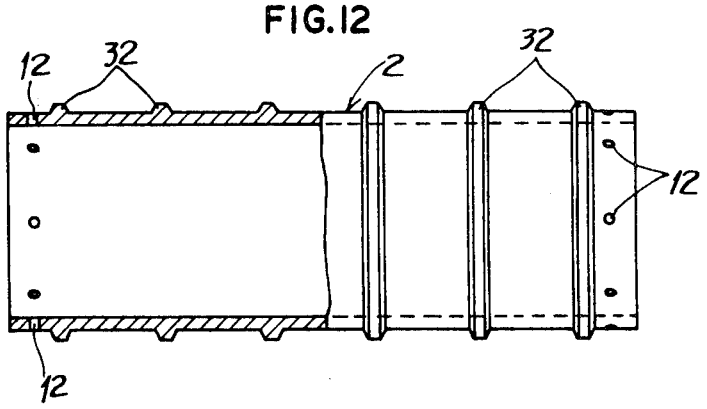
Figure 13:
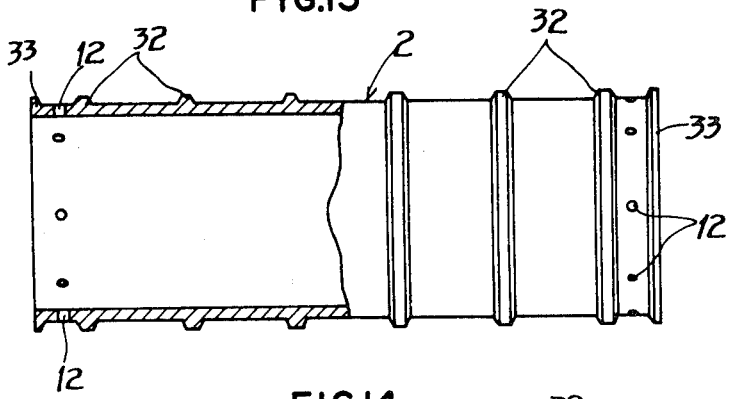
Figure 14:
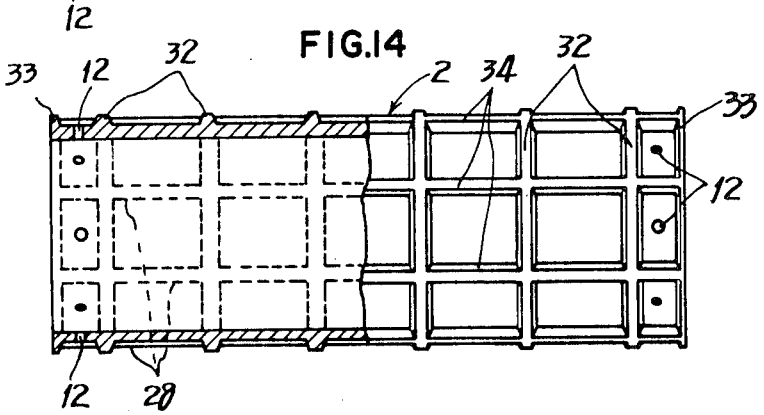
Figure 15:
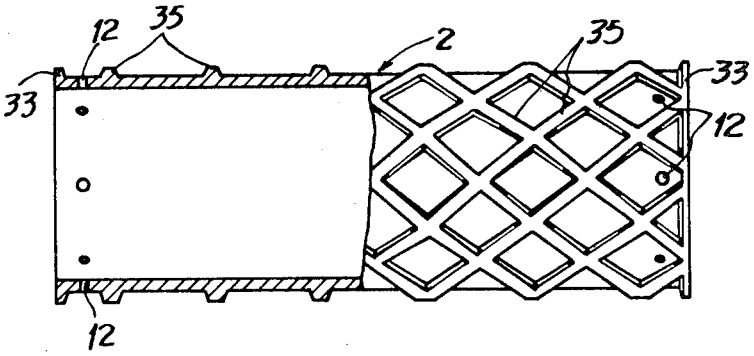
Figure 16:
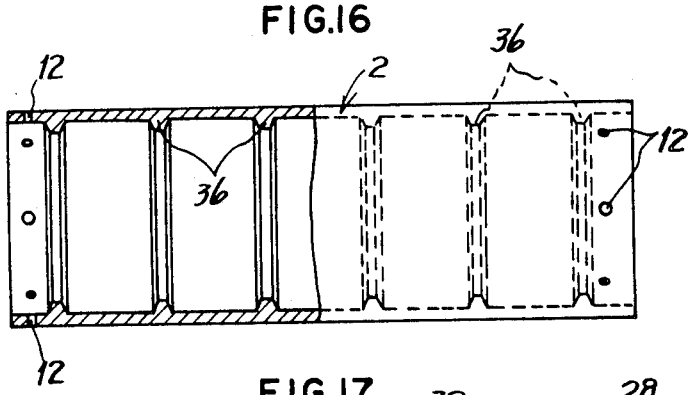

The construction of the unit pipe support members 2 used for the built-up pipe support set 1 described above will now be described with reference to FIGS. 12 through 28. FIGS. 12 through 16 show what corresponds to the first embodiment, and FIGS. 17 through 28 show what corresponds to the second embodiment. These figures will now be described. FIG. 12 shows an arrangement in which annular ribs 32 are formed on the outer peripheral surface of a unit pipe support member 2. FIG. 13 shows an arrangement in which annular ribs 32 are formed on the outer peripheral surface and end annular ribs 33 are also formed on the opposite ends of a unit pipe support member 2, in which case it is possible to increase the area of engagement with the connector pipe 3 or closure pipe 6 and hence strengthen the junction. FIG. 14 shows an arrangement in which longitudinal ribs 34 are added to the FIG. 13 arrangement, thereby increasing the bending strength and compressive strength of the unit pipe support member 2 itself. As a simple application of this arrangement, the lattice pattern ribs of FIG. 14 may be deformed to provide rhombic ribs 35 as shown in FIG. 15, with the same effects retained. Further, the annular ribs may be changed to a spiral rib. FIG. 16 shows a unit pipe support member 2 internally provided with annular ribs 36, it being clear that such annular ribs are as effective as the spiral reinforcement in a pipe support structure. It goes without saying that the same effects can be attained when a rib arrangement similar to that shown in FIG. 14 or 15 is provided on the inner surface of a unit pipe support member 2. FIGS. 12 through 16 illustrate only a straight form as an example of the unit pipe support member 2, but it may be formed of a curved member shaped to the excavated cross-section of a tunnel. In that case, the angle of inclination of the connector pipes 3 and of closure pipes 6 must be changed so as to agree with the shape thereof. For a tunnel having a different excavated cross-sectional shape, it is only necessary to change the number of unit pipe support members 2 to be used and change the number and shape of connector pipes 3. Thus, since the kinds of unit pipe support members can be limited while retaining their versatility, they can be effectively utilized as supporting materials as well as effectively produced.

Figure 17:
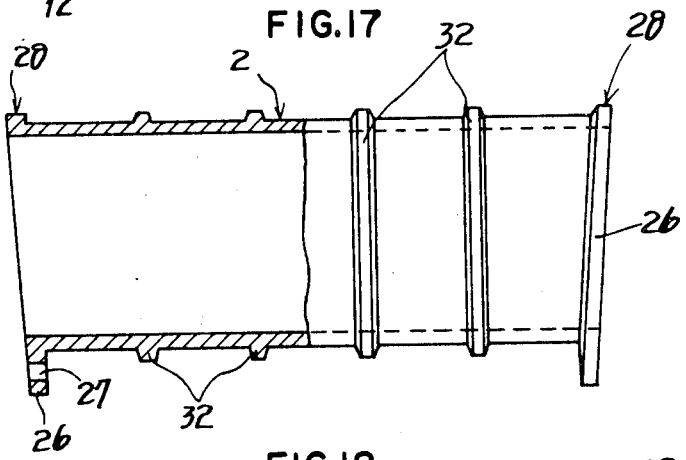
Figure 18:
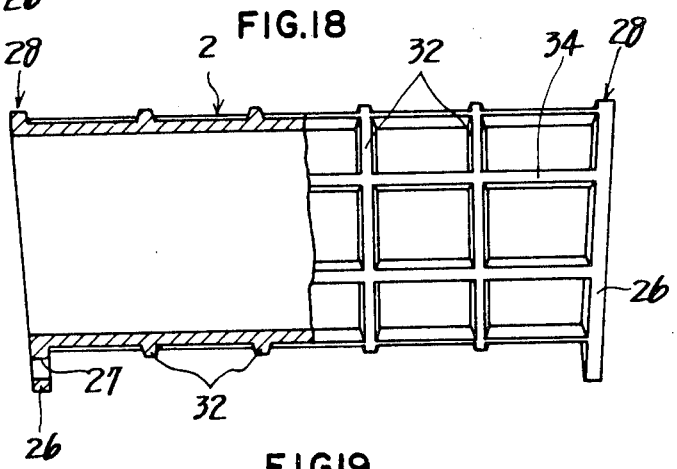
Figure 19:
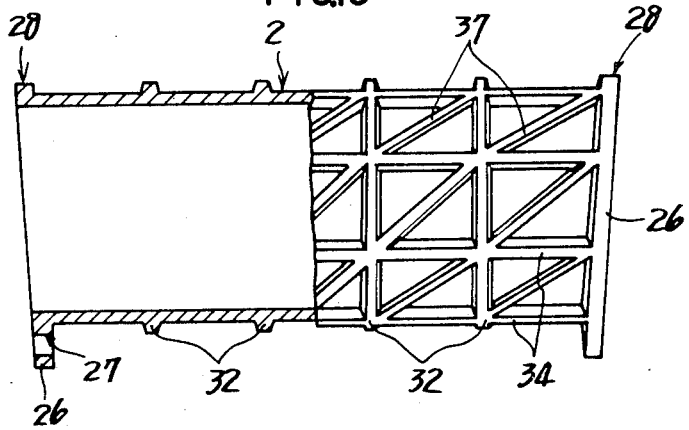
Figure 20:
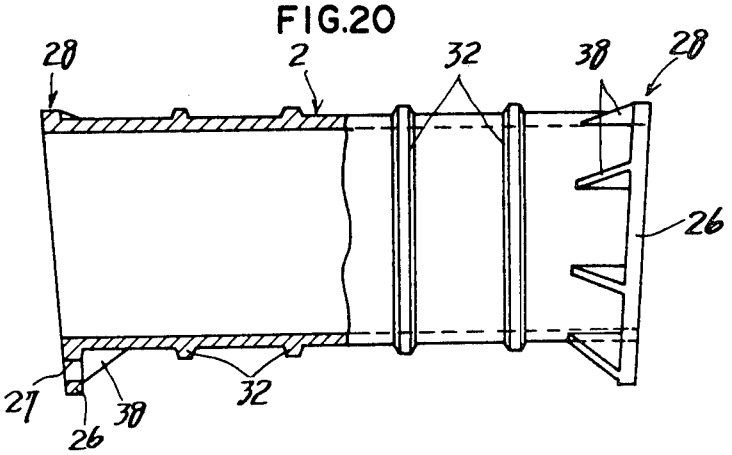
Figure 21:
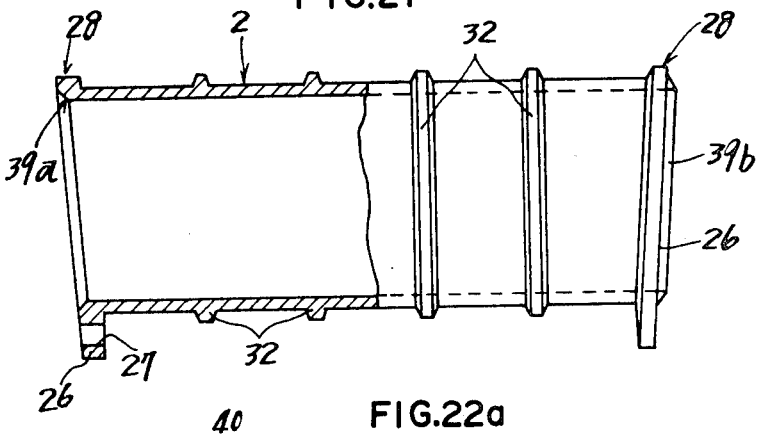
Figure 22A:
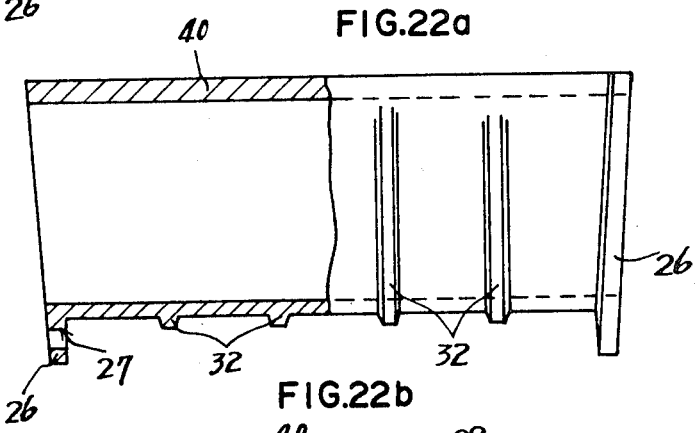
Figure 22B:
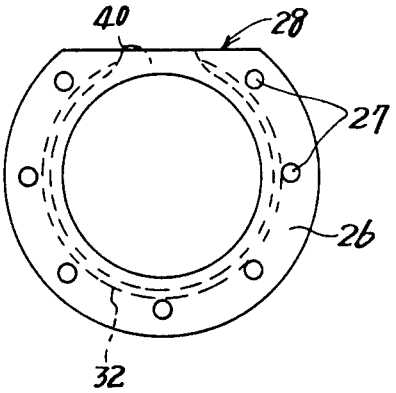

Concrete examples of the construction of the unit pipe support member in the second embodiment will now be described with reference to FIGS. 17 through 28. FIG. 17 shows an arrangement in which said annular ribs 32 are formed on the outer peripheral surface, and FIG. 18 shows such ribs formed on the outer peripheral surface with longitudinal ribs 34 added thereto. Such lattice pattern rib arrangement may be made rhombic as in FIG. 15. Further, as shown in FIG. 19, diagonal ribs 37 may be added to lattice pattern ribs to provide a triangular rib arrangement, or the annular ribs 32 may be replaced by a spiral rib. FIG. 20 shows the provision of reinforcing ribs 38 on a connector flange 26, the rigidity-increasing effect of the reinforcing ribs enabling the thickness of the flange to be reduced and assuring smooth transmission of stress. FIG. 21 shows the provision of a socket and a spigot 39*a*, 39*b* on the opposite ends of a unit pipe support member 2, facilitating the assembly of unit pipe support members and the transmission of a shearing force acting on the junction surface and providing the effect of preventing the leakage of mortar or cement milk. FIGS. 22*a* and 22*b* show an arrangement in which the upper side of a unit pipe support member is formed with a thick-walled portion 40 flush with annular ribs 32 so that the upper surface is smooth, thus facilitating contact of the support set 1 with the earth 9 and assuring easy and reliable driving of sheet piles 8.

Figure 25A:
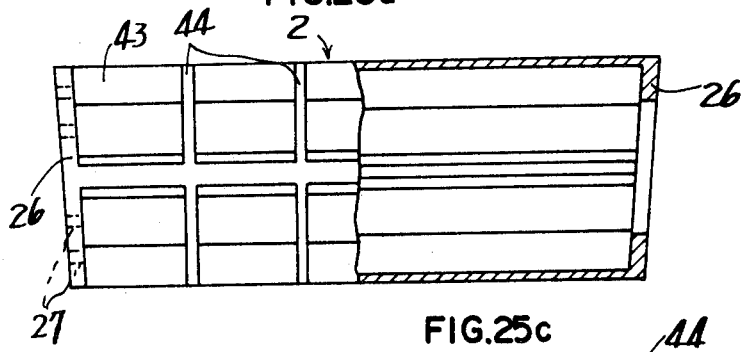
Figure 25B:
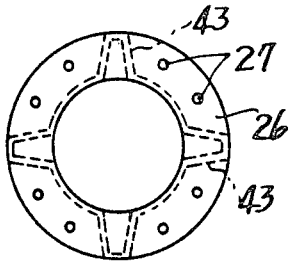
Figure 25C:
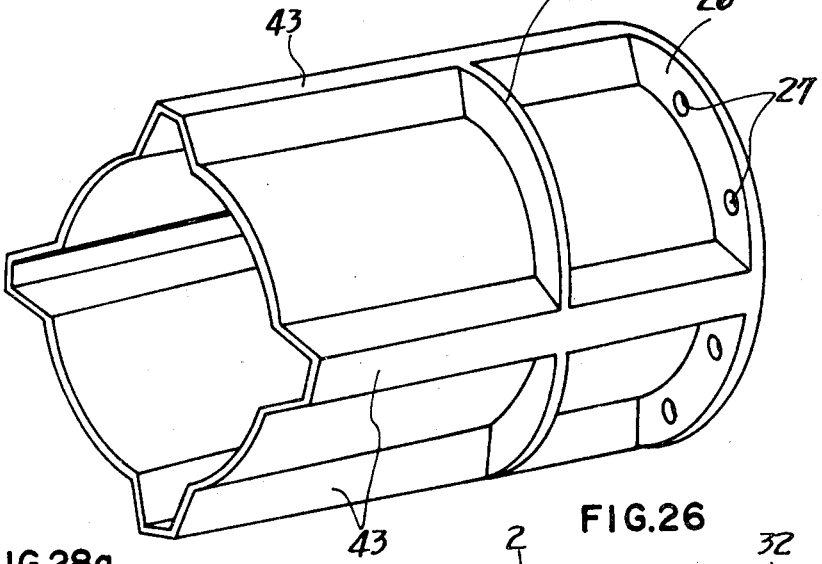
Figure 26:
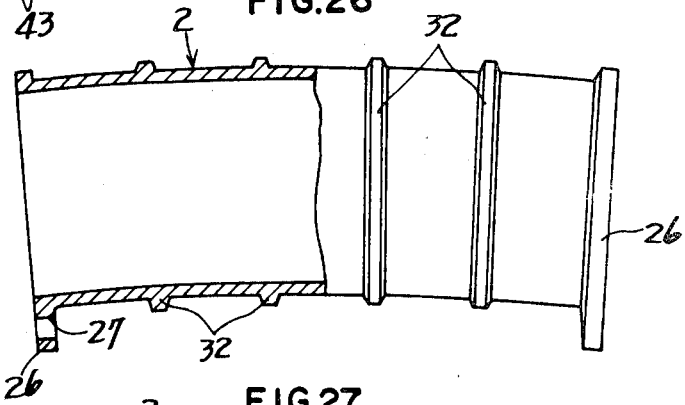
Figure 27:
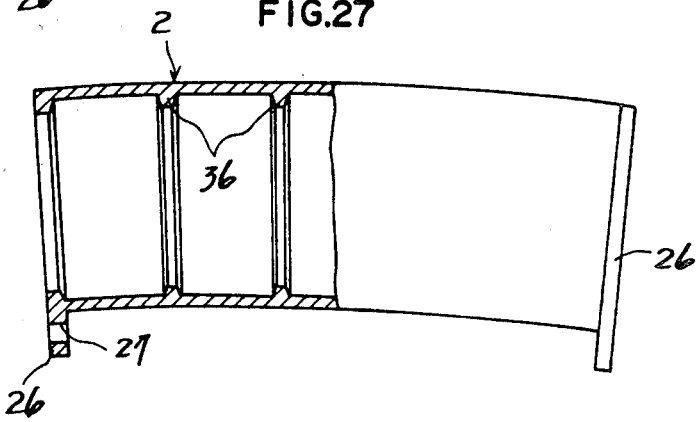

FIGS. 23*a*, 23*b* and 23*c* show the provision of longitudinal ribs 41 on the inner peripheral surface of a unit pipe support member 2, thereby increasing the bending strength and compressive strength of the unit pipe support member 2, the connector flanges 26 being formed so as to extend from the outer periphery to the inner side, the regions where bolt holes 27 are formed being recessed as at 42. In addition, the outer peripheral surface may be provided with annular ribs 32, as shown in FIG. 23*c*. FIGS. 24*a*, 24*b* and 24*c* show an arrangement in which a unit pipe support member 2 is provided with annular ribs 32 on the outer peripheral surface thereof and longitudinal ribs 41 extending axially of the pipe are formed on the inner peripheral surface, as in FIG. 23*c*, but the recesses 42 are dispensed with so that there is no unevenness on the inner peripheral surface of the unit pipe support member 2 except for the longitudinal ribs 41. In such case, the annular ribs 32 perform the same function as that of the spiral reinforcement in a conventional pipe support structure while the longitudinal ribs 41 add to the bending rigidity of the pipe support set and prevent buckling and cooperate with the annular ribs to function in the same manner as in a lattice pattern rib arrangement. Further, when the outer peripheral surface is provided with annular ribs and longitudinal ribs, the presence of the longitudinal ribs would more or less interfere with the driving of sheet piles, but such interference can be eliminated. Particularly in the case of FIGS. 24*a*, 24*b* and 24*c*, concrete or mortar to be packed in the interior is allowed to flow with ease along the inner peripheral surface of the support member, leaving no places unfilled. FIGS. 25*a*, 25*b* and 25*c* show a unit pipe support member 2 having a plurality of longitudinally extending circumferentially spaced ridges 43 of trapezoidal cross-section on the outer peripheral surface thereof, thereby increasing the bending strength and compressive strength of the unit pipe support member, as in the unit pipe support member shown in FIGS. 23*a*, 23*b* and 23*c*. Transverse ribs 44 may be provided between the ridges 43, 43. FIGS. 26 and 27 show an example in which a unit pipe support member 2 is a curved member. FIG. 26 shows such member having annular ribs 32 on the outer peripheral surface thereof, while FIG. 27 shows another one having annular ribs 36 on the inner peripheral surface thereof. The arrangements shown in FIGS. 22 through 25 are applicable to the first embodiment having no connector flange: As for the construction thereof, modifications and combinations of these examples of the construction are possible.

As for the shape of the connector flange 26, various shapes may be contemplated, as shown in FIGS. 28*a* and 28*b*, including one in which the cut-away portion 28 is straight or crowned after the fashion of the annular rib 32, and one in which it is formed to extend from the outer periphery of the pipe toward the inner side without providing a cut-away portion 28. Further, while the unit pipe support members 2 have been shown as being in the form of pipes of circular cross-section, it goes without saying that pipes having other cross-sectional shapes, such as square, trapezoid, triangle, octagon and other polygons, may be used.

We claim:

1. A unit pipe support member for use in a structure for supporting the earth wall of a tunnel or the like by built-up pipe support sets each including a plurality of unit pipe support members, wherein:

said unit pipe support member is a casting of ductile cast iron or cast steel having substantially the same shape and same length as the other of said plurality of unit pipe members;

at least one of the inner and outer surfaces of said unit pipe support member has reinforcing rib means cast integral therewith, said reinforcing rib means comprising continuous annular ribs spaced apart from each other longitudinally of said unit pipe support member;

and connector flanges integrally formed on and reinforcing the opposite ends of said unit pipe support member.

2. A unit pipe support member as set forth in claim 1 wherein said reinforcing rib means further comprises longitudinal ribs spaced apart from each other circumferentially of said unit pipe support member, said annular ribs being located on the outer surface of said unit pipe support member and said longitudinal ribs being located on the inner surface thereof.

3. A unit pipe support member as set forth in claim 1 wherein said reinforcing rib means further comprises a thickened wall portion extending longitudinally between the ends of said unit pipe support member, said annular ribs extending circumferentially and continuously from one side of said thickened wall portion to the other side thereof.

4. In a support structure for supporting the earth wall of a tunnel or the like, the improvement wherein said support structure is constructed of a plurality of unit pipe support members each of which is a casting of ductile iron or steel having reinforcing rib means integrally formed in at least one of the inner and outer surfaces thereof, said reinforcing rib means comprising continuous annular ribs spaced apart from each other longitudinally of each unit pipe support member;

connector means for connecting the ends of said unit pipe support members to form a support set having an outer peripheral surface adapted to be positioned adjacent to the peripheral surface of said earth wall, said connector means including means for reinforcing said support set at the connections between the ends of said unit pipe support members; and, bolt means engageable with said connector means.

5. A support structure as set forth in claim 4 wherein said connector means include reinforced metal fittings adapted to be attached to the ends of said unit pipe support members, said reinforced metal fittings having lap joint portions adapted to be fitted in the ends of said unit pipe support members and connected thereto by said bolt means, and a reinforced step portion between said lap joint portions.

6. A support structure as set forth in claim 4 wherein the opposite ends of said pipe support set are provided with metallic bottom plates.

7. A support structure as set forth in claim 4 wherein said pipe support set is filled with a core filler.

8. A support structure as set forth in claim 4 wherein said reinforcing rib means further comprises longitudinal ribs spaced apart from each other circumferentially of each unit pipe support member, said annular ribs being located on the outer surface of said unit pipe support member and said longitudinal ribs being located on the inner surface thereof, and said pipe support set is filled with a core filler.

* * * * *